US007314376B2

(12) United States Patent
Yagi et al.

(10) Patent No.: US 7,314,376 B2
(45) Date of Patent: Jan. 1, 2008

(54) ELECTRIC DISTRIBUTION BOX

(75) Inventors: Sakai Yagi, Shizuoka (JP); Yoshiaki Ichikawa, Shizuoka (JP); Shigeki Matsumoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/393,699

(22) Filed: Mar. 31, 2006

(65) Prior Publication Data

US 2006/0234527 A1 Oct. 19, 2006

(30) Foreign Application Priority Data

Apr. 15, 2005 (JP) ..... P2005-117654

(51) Int. Cl.
*H01R 12/00* (2006.01)

(52) U.S. Cl. ..... 439/76.2; 439/885

(58) Field of Classification Search ..... 439/76.2, 439/212–214, 723, 724, 852, 885
See application file for complete search history.

(56) References Cited

U.S. PATENT DOCUMENTS 3,548,367 A * 12/1970 Bruetsch ..... 439/724
5,554,040 A * 9/1996 Sugiura et al. ..... 439/212
5,611,713 A * 3/1997 Takeuchi ..... 439/752.5
5,755,579 A * 5/1998 Yanase et al. ..... 439/76.2
2002/0022387 A1* 2/2002 Sumida ..... 439/76.2
2006/0105589 A1* 5/2006 Ackerman et al. ..... 439/34

FOREIGN PATENT DOCUMENTS

JP 2004-282908 10/2004

* cited by examiner

*Primary Examiner*—James R. Harvey
(74) *Attorney, Agent, or Firm*—Finnegan, Henderson, Farabow, Garrett & Dunner, L.L.P.

(57) ABSTRACT

An electric distribution box for containing a distribution parts includes a first case, a second case that is attached to the first case, and a female-female terminal that has holding portions for holding and electrically connecting mating terminals. A first recess portion is provided on one of the first and second cases, and receives a part of the female-female terminal. A second recess portion is provided on the other of the first and second cases, and receives a remaining part of the female-female terminal. An inserting hole for inserting one of the mating terminal to contact with the female-female terminal is formed in at least one of the first and second recess portions.

6 Claims, 8 Drawing Sheets

ELECTRIC DISTRIBUTION BOX

BACKGROUND OF THE INVENTION

This invention relates to an electric distribution box in which female-female terminals for electrically and mechanically connecting connection terminals of bus bars, distribution parts, etc., are received and supported in a case or a plate such as a board.

In many electric connection equipments of the type in which high voltage is dealt with within a limited space, electric wiring within the equipment is formed by installing strip-like bus bars. One example of such equipments is an electric distribution box.

For example, in a hybrid car, an electric car, a fuel cell car or the like, a battery, an ignition switch, an inverter, etc,. are provided via this electric distribution box, and an electromagnetic relay is operated based on an output signal from the ignition switch, and main power is transmitted to the inverter while a voltage sensor detects the condition of the battery (see, for example, JP-A-2004-282908 (Page 1, FIG. 1)).

One example of the construction of such electric distribution box will be described. For example, as shown in FIG. 7, the electric distribution box comprises a lower case z1 having distribution part-receiving portions (not shown) respectively receiving distribution parts (such as fuses, an electromagnetic relay and a pressure sensor) and recess portions z2, bus bars z4 each installed on the lower case z1 and having a connection terminal z5 received in an upstanding manner within the corresponding recess portion z2, female-female terminals z3 which are completely received within the respective recess portions z2, and grip the respective connection terminals z5, and an upper case z6 which is detachably fitted on the lower case z1, and has external connection terminal-inserting holes z7 for the passage of external connection terminals of the distribution parts, etc., therethrough. As described above, for example, main power is transmitted to the inverter or the like by the ON/OFF operation of the ignition switch.

In the related electric distribution box, the upper case z6 is fitted on the lower case z1 having the female-female terminals completely received with the respective recess portions z2 as described, and therefore the following problems have been encountered.

Namely, there are occasions when the external connection terminal-inserting hole z7 and the corresponding female-female terminal z3 are slightly displaced out of registry with each other from some cause, so that the external connection terminal can not be easily inserted into the female-female terminal z3.

For example, when the upper case is caused to strike against a working table or the like, the external connection terminal-inserting hole z7 and the corresponding female-female terminal z3 are slightly displaced out of registry with each other.

In such a case, the worker again carefully inserted the external connection terminal into the female-female terminal, and therefore there has been room for further improvement.

And besides, the side surfaces of the related female-female terminal are flat, and therefore there are occasions when the female-female terminal is inserted in a wrongly-oriented manner into the recess portion. In this case, the external connection terminal-inserting hole and a holding portion of the corresponding female-female terminal are completely displaced out of registry with each other, so that the external connection terminal, in some cases, has failed to be connected to the female-female terminal.

Therefore, as shown in FIG. 8, there has been proposed an electric distribution box in which external connection terminal-inserting holes z10 for the passage of external connection terminals of distribution parts, etc., therethrough are formed in an upper case z9, and recess portions z11 for respectively receiving female-female terminals z3 are formed on this upper case in surrounding relation respectively to the peripheries of the holes z10, thereby preventing a holding portion of the female-female terminal z3, received in each recess portion z11, from being brought out of registry with the corresponding external connection terminal-inserting hole z10.

In the above electric distribution box, although the misregistration of the holding portion of each female-female terminal z3 relative to the external connection terminal-inserting hole z10 can be prevented, the following problem is encountered.

Namely, an upper surface of a lower case on which a plurality of bus bars are installed is flat, and therefore the shortest distance (that is, the creeping distance measured along an insulating surface) between the two conducting members, that is, each female-to-female terminal z3 and each of those bus bars (other than the bus bar to which this female-female terminal z3 is connected) disposed near to this female-female terminal z3, becomes smaller as compared with the related structure in which the recess portions are formed on the upper surface of the lower case, and as a result a problem has arises with the insulating performance.

SUMMARY OF THE INVENTION

It is therefore an object of this invention to provide an electric distribution box in which each external connection terminal-inserting hole is prevented from being disposed out of registry with a corresponding female-female terminal while securing a sufficient creeping distance between the female-female terminal and each of nearby bus bars, and besides wrong insertion of the female-female terminal into a recess portion is prevented, thereby enhancing the connecting reliability of external connection terminals.

The above object has been achieved by an electric distribution box of the present invention having the following technical features.

Namely, the invention provides an electric distribution box for containing a distribution parts, comprising:

a first case;

a second case that is attached to the first case; and a female-female terminal that has holding portions for holding and electrically connecting mating terminals, wherein a first recess portion is provided on one of the first and second cases, and receives a part of the female-female terminal;

wherein a second recess portion is provided on the other of the first and second cases, and receives a remaining part of the female-female terminal; and wherein an inserting hole for inserting one of the mating terminal to contact with the female-female terminal is formed in at least one of the first and second recess portions.

Preferably, the female-female terminal has a convex portion formed on a side face thereof. An inserting direction-limiting portion is formed on at least one of the first and second recess portions, and is engaged with the convex portion to limit an inserting direction of the female-female terminal.

Preferably, the inserting direction-limiting portion is a recess portion that engages with the convex portion of the female-female terminal.

Preferably, a projecting portion is formed on either one of the first and second recess portions to guide one of the mating terminals to one of the holding portions of the female-female terminal.

Preferably, the female-female terminals includes a frame body having a generally rectangular shape when viewed from the top, and a strip-like resilient piece portion which is provided on the frame body, and is bent downwardly and upwardly so as to form an upper U-shaped portion and a lower U-shaped portion to form the holding portions.

In the electric distribution box of the invention, the first recess portions each for receiving part of the corresponding female-female terminal is formed at the one of the upper case (first case) and the lower case (second case), and the second recess portion for receiving the remainder of the female-female terminal is formed at the other of the upper and lower cases, and the female-female terminal is held by the upper and lower cases. Therefore, there can be provided the electric distribution box in which an external connection terminal-inserting hole, formed at one or both of the first and second recess portions, will not be disposed out of registry with the corresponding female-female terminal, thereby enhancing the connecting reliability of the external connection terminal. And besides, thanks to the provision of the first recess portion for receiving part of the female-female terminal, the creeping distance between the female-female terminal and the nearby bus bars is increased, so that a satisfactory insulating performance can be secured.

Furthermore, the convex portion, formed on the side surface of the female-female terminal, is engaged in the inserting direction-limiting portion formed at the first recess portion and the second recess portion, thereby limiting the inserting direction of the female-female terminal. Therefore, there can be provided the excellent electric distribution box in which the wrong insertion of the female-female terminal into the first and second recess portions is prevented.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
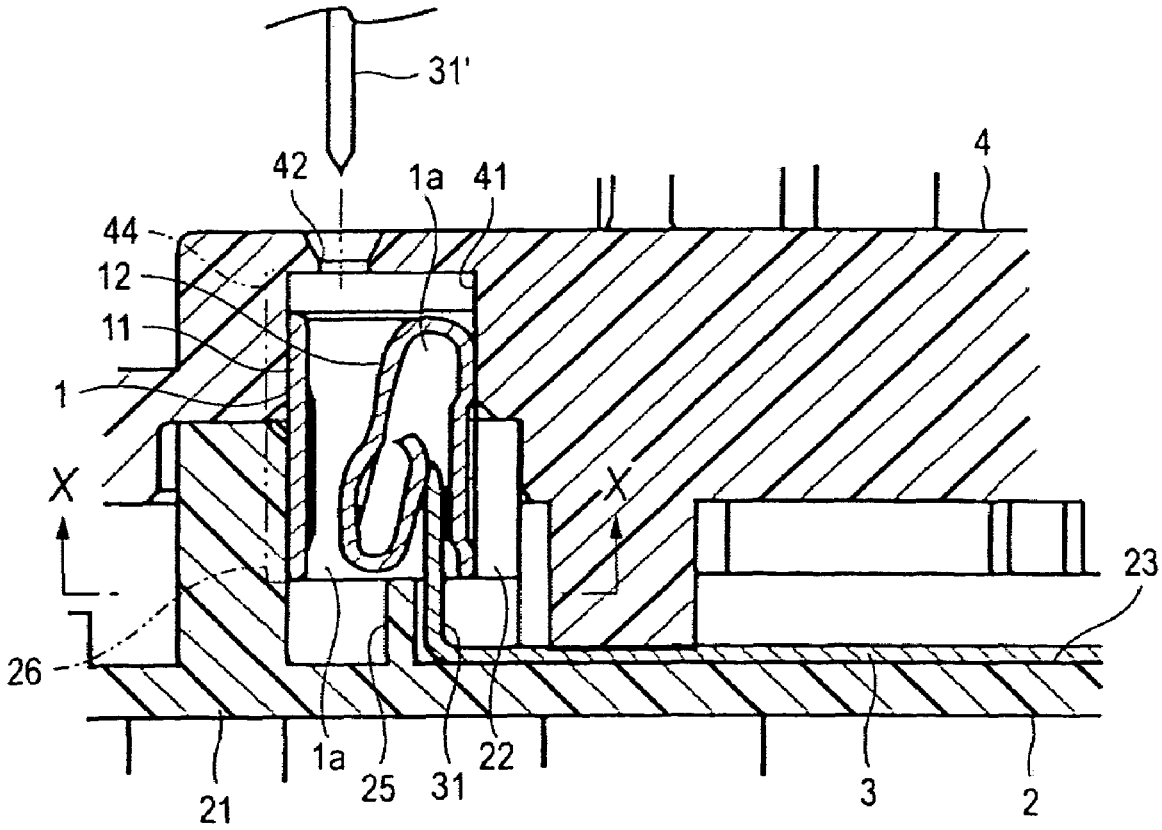
FIG. 1 is a vertical cross-sectional view of an important portion of a preferred embodiment of an electric distribution box A of the present invention.

A preferred embodiment of an electric distribution box of the present invention will now be described with reference to the accompanying drawings. The electric distribution box of this embodiment is used as an automotive part. A battery, an ignition switch, an inverter, etc., are provided via the electric distribution box, and an electromagnetic relay is operated based on an output signal from the ignition switch, and main power is transmitted to the inverter while a voltage sensor detects the condition of the battery, and the functions of the electric distribution box are well known. In the drawings, reference numeral 1 denotes female-female terminals, reference numeral 2 denotes a lower case, reference numeral 3 denotes bus bars, and reference numeral 4 denotes an upper case.

The electric distribution box A of this embodiment includes the female-female terminals 1, the lower case 2, and the upper case 4.

Figure 2:
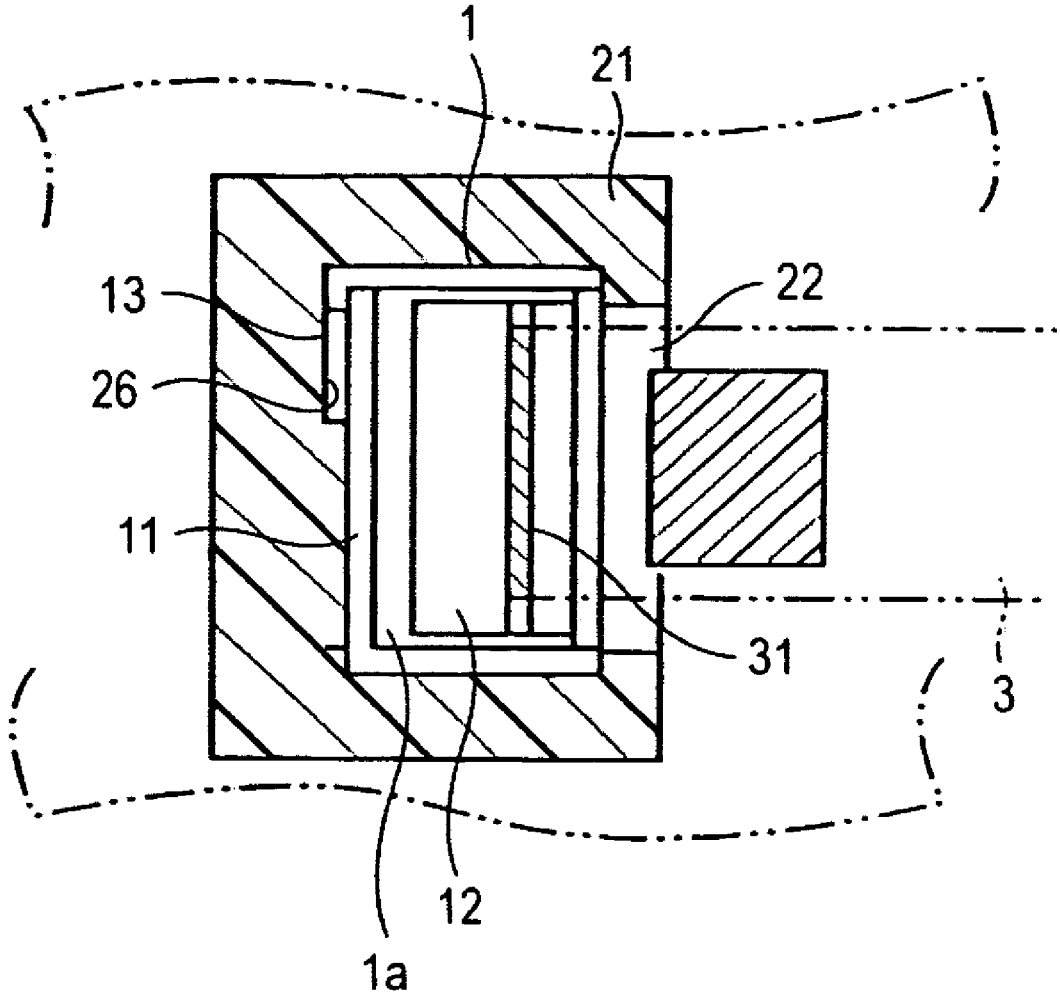
FIG. 2 is a view taken along the line X-X of FIG. 1.

The female-female terminal 1 is formed of an electrically-conductive metallic material. As shown in FIGS. 1 and 2, the female-female terminal 1 includes a frame body 11 (having a generally rectangular shape when viewed from the top) having an overlapping portion formed at one corner portion thereof. One side wall of the frame body 11 is bent back downwardly at an upper portion of the frame body 11, and is further is bent back upwardly at a lower portion of the frame body 11 to thereby form a strip-like resilient piece portion 12 having generally U-shaped upper and lower portions. The female-female terminal 1 has a pair of holding portions 1*a* formed respectively between one of the opposite side walls of the frame body 11 and the resilient piece portion 12 and between the other side wall of the frame body 11 and the resilient piece portion 12. A connection terminal 31 of the bus bar 3 (The bus bars 3 form circuits of the electric distribution box A) is inserted into one of the two holding portions 1*a* from the lower side, while a connection terminal 31' of a distribution part or an external equipment is inserted into the other holding portion 1*a* from the upper side.

The frame body 11 has the overlapping portion formed at the one corner portion thereof (that is, at an upper left corner portion in FIG. 2), the overlapping portion defining a convex portion 13.

Each of the bus bars 3 is formed by blanking a strip-like member from an electrically-conductive metal sheet (such as a copper sheet) by a pressing machine or the like so that a desired wiring pattern can be provided, and then if necessary, a desired portion of the blanked portion is bent to form the connection terminal 31 for connection to the female-female terminal 1.

The bus bars 3 are installed on the lower case 2 in such a manner that the connection terminals 31 (each formed by bending the end portion of the bus bar 3 upwardly) project upwardly. The lower case 2 has first recess portions 21 and distribution part-receiving portions (not shown) formed on an upper surface of the lower case 2. The first recess portions 21 receive the respective female-female terminals 1 each gripping the connection terminal 31, and the distribution part-receiving portions receives the respective distribution parts (such as fuses, an electromagnetic relay and a pressure sensor) forming the electric circuits of the electric distribution box A. Engagement portions 24 for engagement with respective retaining portions 43 of the upper case 4 (described later) are formed on side surfaces of the lower case 2.

Figure 3:
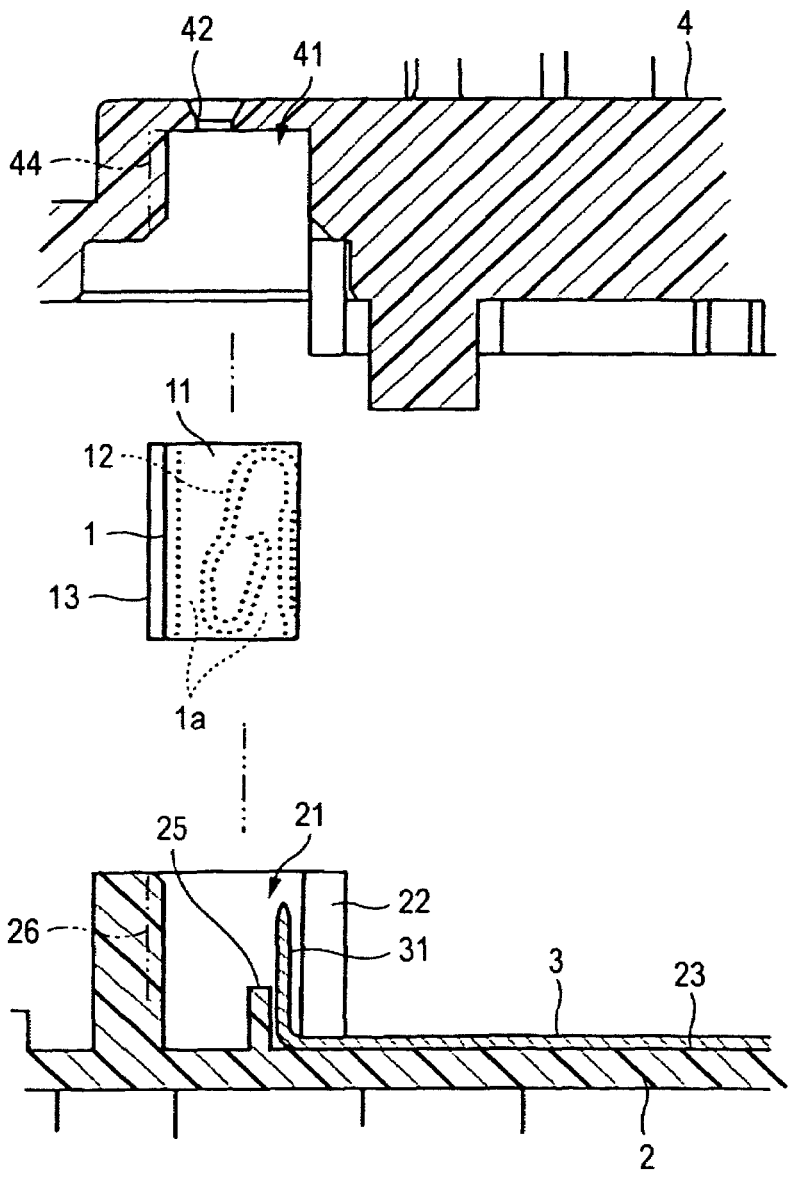
FIG. 3 is an exploded, vertical cross-sectional view of the portion of FIG. 1.
Figure 4:
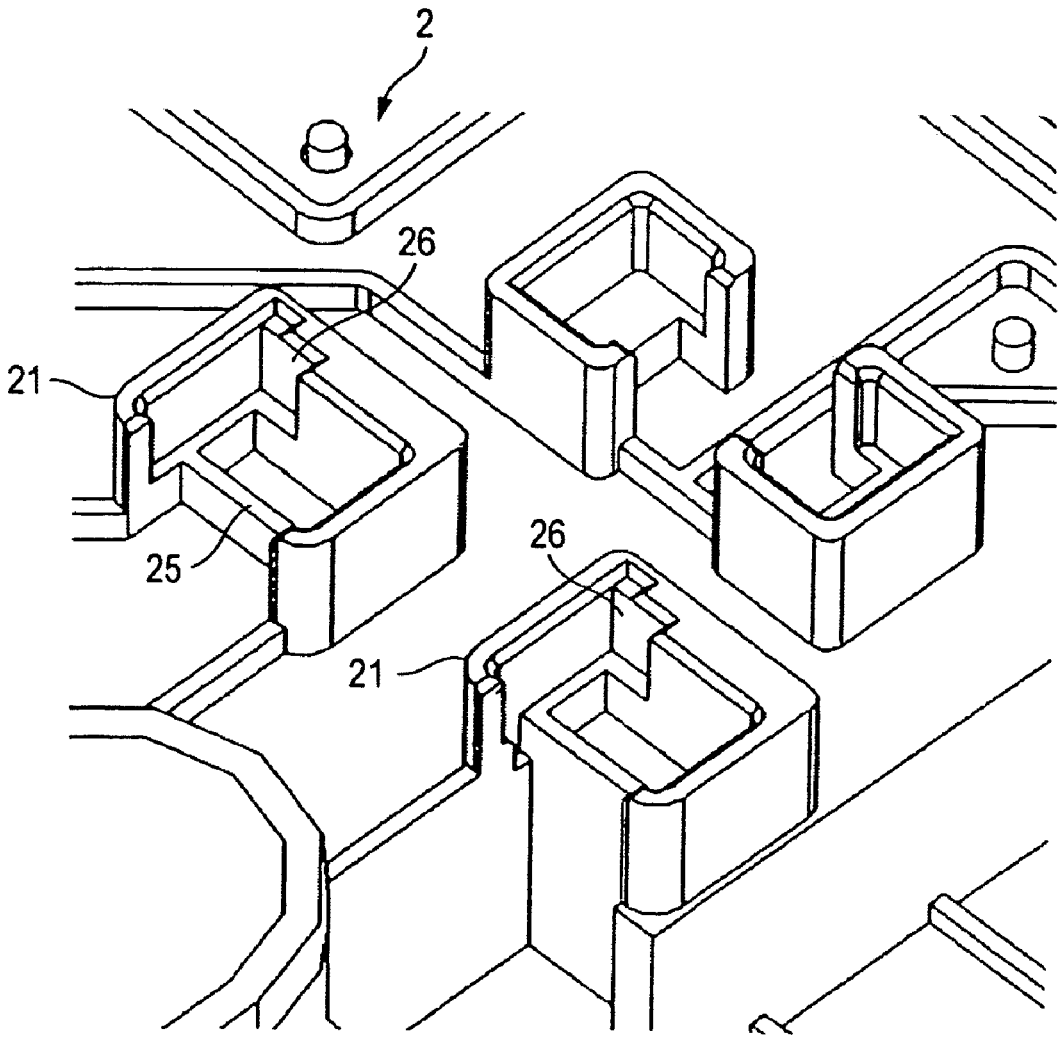
FIG. 4 is a perspective view showing an important portion of a lower case of the electric distribution box A of the embodiment.

As shown in FIGS. 2 to 4, each first recess portion 21 has a generally rectangular shape when viewed from the top, and has an open portion 22 for installing the bus bar 3. A projecting portion 25 is formed within the first recess portion 21, and is disposed close to the open portion 22. The projecting portion 25 supports the female-female terminal 1 in such a manner that the female-female terminal 1 is spaced upwardly from a bus bar installation surface 23 formed on the upper surface of the lower case 2, and also the projecting portion 25 abuts against the bus bar 3 to thereby guide the connection terminal 31 upwardly.

The first recess portion 21 (having the generally rectangular shape when viewed from the top) has an inserting direction-limiting portion 26 (into which the convex portion 13 of the female-female terminal 1 is inserted) formed in an inner side surface thereof, and this inserting direction-limiting portion 26 serves to prevent wrong insertion of the female-female terminal 1 into the first recess portion 21

The first recess portion 21 is formed into such a predetermined depth that a generally upper half portion of the female-female terminal 1 projects outwardly from the first recess portion 21 when the female-female terminal 1 is received in the first recess portion 21. Also, the inner periphery of the first recess portion 21 has such a predetermined size that the female-female terminal 1 can be inserted and fitted thereinto.

Thanks to the provision of the first recess portions 21, a sufficient creeping distance is secured between each female-female terminal 1 and each of the nearby bus bars (that is, those bus bars other than the bus bar to which this female-female terminal 1 is connected), thereby securing a satisfactory insulating performance.

Second recess portions 41 for respectively receiving the generally upper half portions of the female-female terminals 1 are formed in a lower surface of the upper case 4. External connection terminal-inserting holes 42 for the passage of the downwardly-extending external connection terminals 31' of the distribution parts and external equipments therethrough are formed respectively in predetermined portions of the upper case 4. The retaining portions 43 for engagement with the respective engagement portions 24 of the lower case 2 are formed on side surfaces of the upper case 4 so that the upper case 4 can be detachably engaged with the lower case 2.

A second inserting direction-limiting portion 44 is formed within each second recess portion 41 so as to be continuous with the corresponding inserting direction-limiting portion 26 formed at the lower case 2, and the female-female terminal 1 can be inserted into this limiting portion 44.

Next, a procedure of assembling the electric distribution box A of this embodiment, having the above construction, will be described. First, the distribution parts are received respectively in the distribution part-receiving portions (not shown) of the lower case 2, and the bus bars 3 are installed on the bus bar installation surface 23, thereby forming the desired circuits on the lower case 2. At this time, the connection terminal 31 of the bus bar 3 is brought into abutting engagement with the projecting portion 25 of the first recess portion 21, thereby positioning the connection terminal 31 received in a projecting manner within the first recess portion 21.

Figure 5:
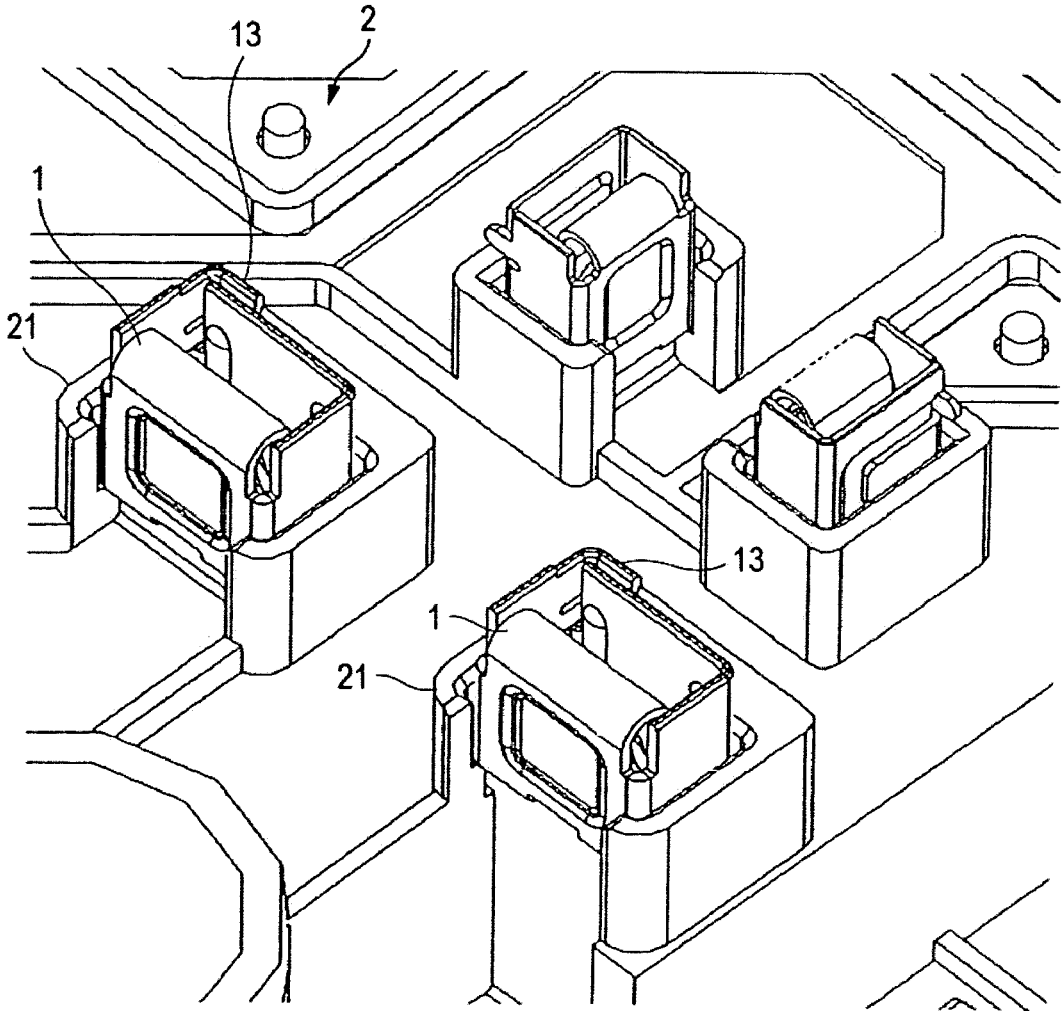
FIG. 5 is a perspective view showing a condition in which female-female terminals are received in the lower case 2 of FIG. 4.
Figure 6:
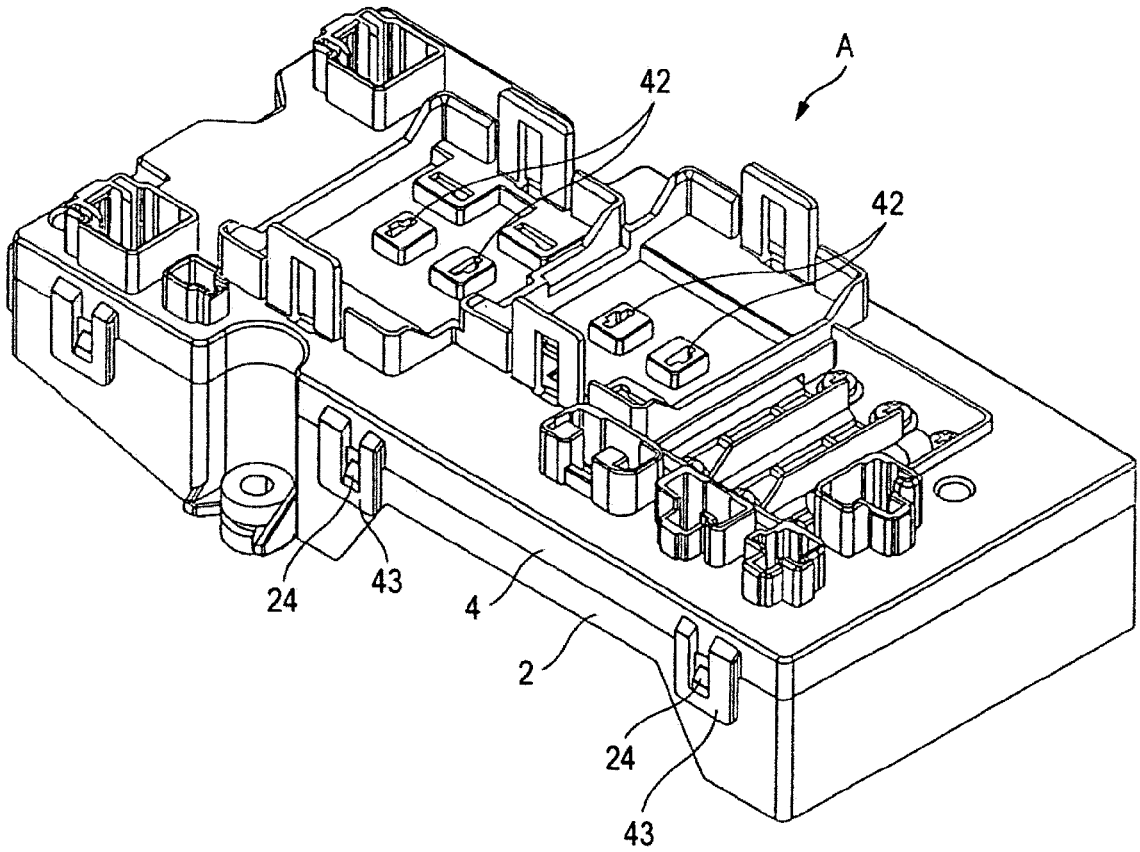
FIG. 6 is a perspective view showing the appearance of the electric distribution box A of the embodiment.
Figure 7:
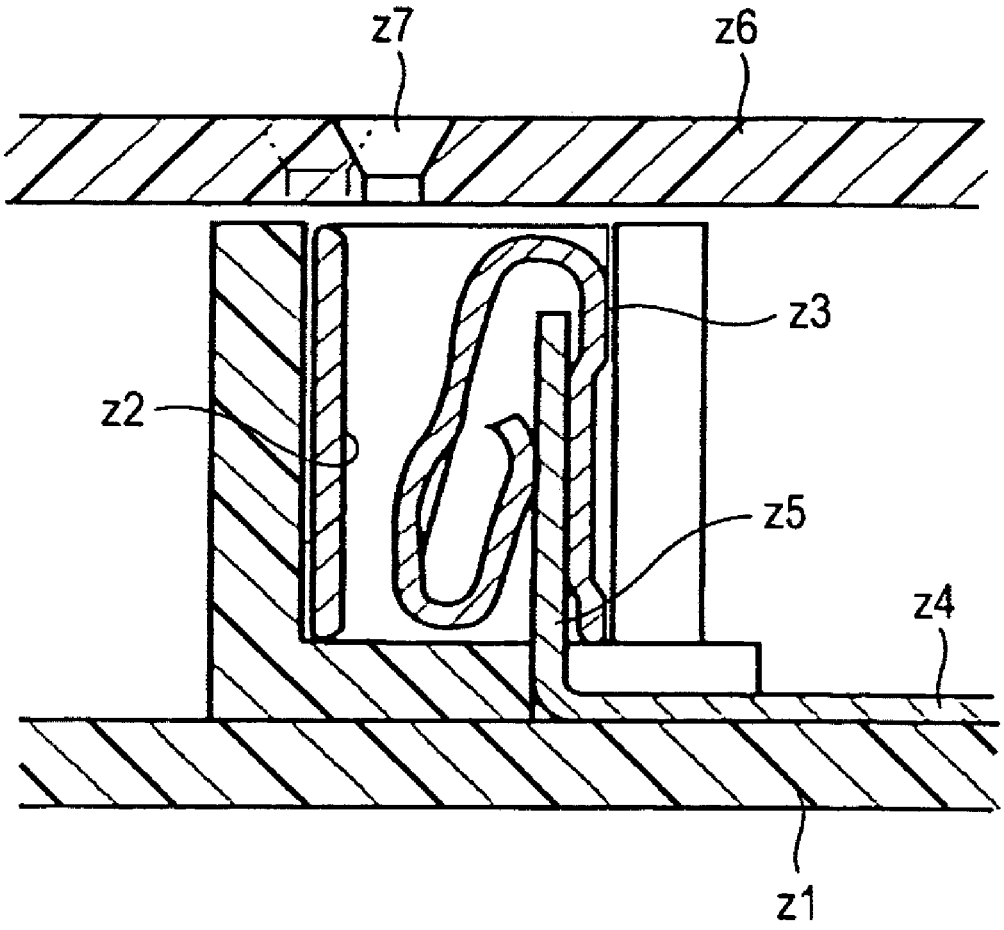
FIG. 7 is a vertical cross-sectional view of a related electric distribution box.
Figure 8:
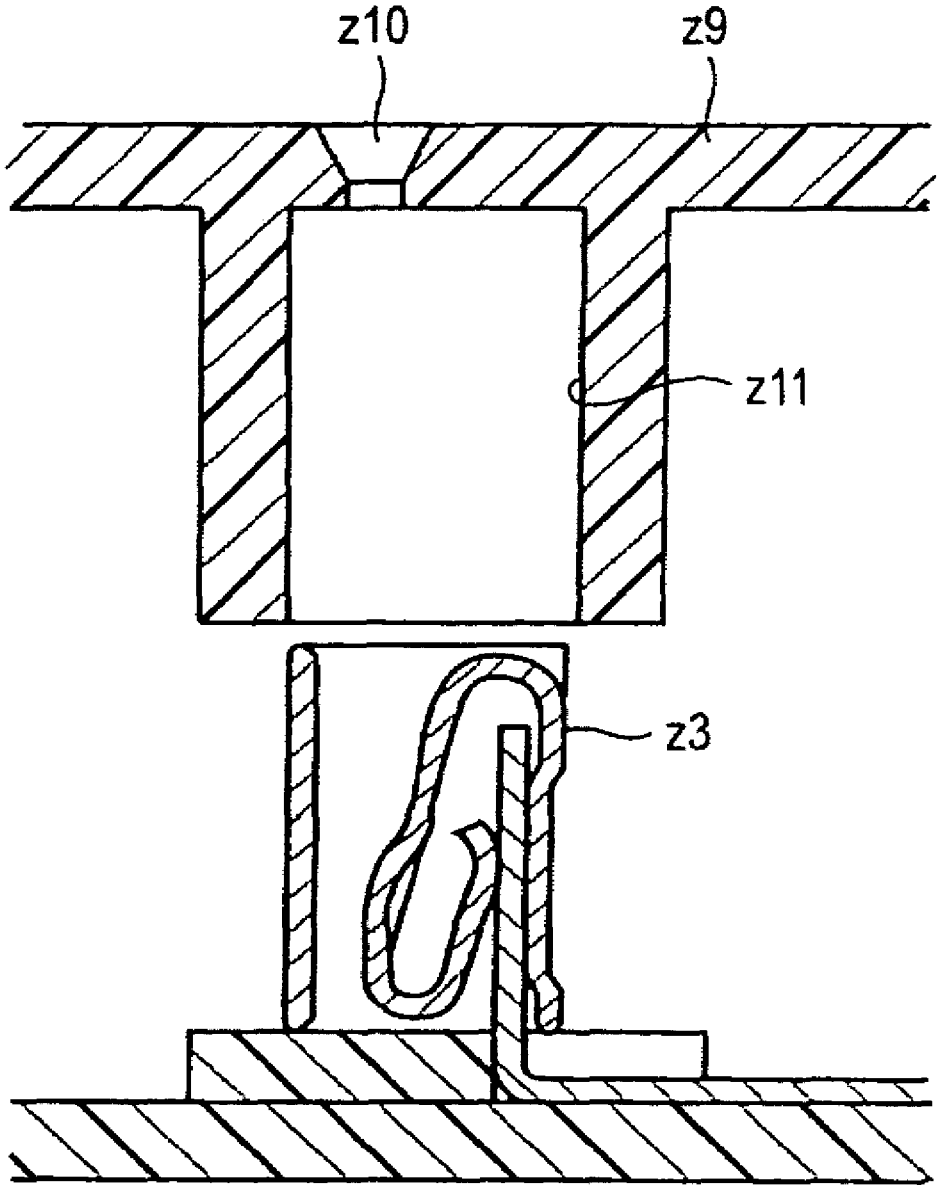
FIG. 8 is a vertical cross-sectional view of another related electric distribution box.

Then, while confirming the orientation of the female-female terminal 1 so that its convex portion 13 can be engaged in the inserting direction-limiting portion 26, each female-female terminal 1 is inserted the corresponding first recess portion 21 (in which the connection terminal 31 of the bus bar 3 is received in a projecting manner) until the female-female terminal 1 is brought into abutting engagement with the projecting portion 25. At this time, the connection terminal 31 of the bus bar 3 is fitted in the holding portion 1*a*, and the female-female terminal 1 is received in the first recess portion 21. This received condition is shown in FIG. 5.

Then, the upper case 4 is fitted on the lower case 4 in such a manner that the retaining portions 43 of the upper case 4 are engaged respectively with the engagement portions 24 of the lower case 2. At this time, the generally upper half portion of the female-female terminal 1 is received in the second recess portion 41 in such a manner that the generally upper half portion of the convex portion 13 of the female-female terminal 1 is engaged in the second inserting direction-limiting portion 44 formed within the second recess portion 41.

Then, the external connection terminals 31' of the distribution parts and external equipments are passed respectively through the external connection terminal-inserting holes 42 formed in the upper case 4, and as a result each of these external connection terminal 31' is inserted into the other holding portion 1*a* opposed to the holding portion 1*a* in which the connection terminal 31 of the bus bar 3 is fitted. Therefore, the external connection terminals 31' of the distribution parts and external equipments are electrically connected to the respective connection terminals 31 of the bus bars 3 via the respective female-female terminals 1.

As described above, in the electric distribution box A of this embodiment, the first recess portions 21 for respectively receiving the generally lower half portions of the female-female terminals 1 are formed on the lower case 2, while the second recess portions 41 for respectively receiving the generally upper half portions of the female-female terminals 1 are formed at the upper case 4. The female-female terminals 1 are held by the upper case 4 and the lower case 2, thereby eliminating a fear that the external connection terminal-inserting holes 42 are disposed out of registry with the respective female-female terminals 1, and at the same time the sufficient creeping distance is secured, thereby positively insulating each female-female terminal 1 from the nearby bus bars.

And besides, the convex portion 13 is formed on the female-female terminal 1, and the inserting direction-limiting portions 26 and the second inserting direction-limiting portions 44 (in which the convex portions 13 can be engaged) are formed in the lower case 2 and the upper case 4 so as to limit the inserting direction of each female-female terminal 1, thereby preventing the wrong insertion of the female-female terminal 1 into the first and second recess portions 21 and 41.

Although the electric distribution box A of this embodiment has been described above, this electric distribution box is merely one example of preferred embodiments of the invention, and therefore the invention is not limited to the above embodiment, and various modifications can be made without departing from the subject matter of the invention.

For example, in the above embodiment, although the convex portion 13 is defined by the overlapping portion formed at the one corner portion of the frame body 11 (that is, the upper left corner portion in FIG. 2), the shape and disposition of the convex portion are arbitrary and are not limited in so far as it can limit the inserting direction of the female-female terminal.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-117654 filed on Apr. 15, 2005, the contents of which are incorporated herein for reference.

What is claimed is:

1. An electric distribution box for containing distribution parts, comprising:

a first case a second case that is attached to the first case; and a female-female terminal that has holding portions for holding and electrically connecting mating terminals, wherein a first recess portion is provided on one of the first and second cases, and the first recess portion is configured to receive a part of the female-female terminal when the part of the female-female terminal is inserted into the first recess portion in an insertion direction;

wherein a second recess portion is provided on the other of the first and second cases, and receives a remaining part of the female-female terminal;

wherein an inserting hole for inserting one of the mating terminals to contact with the female-female terminal is formed in at least one of the first and second recess portions, wherein the inserting hole is configured to receive a connection terminal in a direction that is substantially the same as the insertion; and wherein the female-female terminals includes:

a frame body having a generally rectangular shape when viewed from the top; and a strip-like resilient piece portion which is provided on the frame body, and is bent downwardly and upwardly so as to form an upper U-shaped portion and a lower U-shaped portion to form the holding portions.

2. The electric distribution box according to claim 1, wherein the female-female terminal has a convex portion formed on a side face thereof; and wherein an inserting direction-limiting portion is formed on at least one of the first and second recess portions, and is engaged with the convex portion to limit an inserting direction of the female-female terminal.

3. The electric distribution box according to claim 2, wherein the inserting direction-limiting portion is a third recess portion that engages with the convex portion of the female-female terminal.

4. The electric distribution box according to claim 2, wherein a projecting portion is formed on either one of the first and second recess portions to guide one of the mating terminals to one of the holding portions of the female-female terminal.

5. An electric distribution box for containing distribution parts, comprising:

a first case;

a second case that is attached to the first case; and a female-female terminal that has holding portions for holding and electrically connecting mating terminals and includes:

a frame body having a generally rectangular shape when viewed from the top; and a strip-like resilient piece portion which is provided on the frame body, and is bent downwardly and upwardly so as to form an upper U-shaped portion and a lower U-shaped portion to form the holding portions, wherein a first recess portion is provided on one of the first and second cases, and receives a part of the female-female terminal;

wherein a second recess portion is provided on the other of the first and second cases, and receives a remaining part of the female-female terminal; and wherein an inserting hole for inserting one of the mating terminals to contact with the female-female terminal is formed in at least one of the first and second recess portions.

6. An electric distribution box for containing distribution parts, comprising:

a first case a second case that is attached to the first case; and a female-female terminal that has holding portions for holding and electrically connecting mating terminals, wherein a first recess portion is provided on one of the first and second cases, and the first recess portion is configured to receive a part of the female-female terminal when the part of the female-female terminal is inserted into the first recess portion in an insertion direction;

wherein a second recess portion is provided on the other of the first and second cases, and receives a remaining part of the female-female terminal;

wherein an inserting hole for inserting one of the mating terminals to contact with the female-female terminal is formed in at least one of the first and second recess portions, wherein the inserting hole is configured to receive a connection terminal in a direction that is substantially the same as the insertion direction wherein the female-female terminal has a convex portion formed on a side face thereof;

wherein an inserting direction-limiting portion is formed on at least one of the first and second recess portions, and is engaged with the convex portion to limit an inserting direction of the female-female terminal; and wherein a projecting portion is formed on either one of the first and second recess portions to guide one of the mating terminals to one of the holding portions of the female-female terminal.

* * * * *